US008215889B2

(12) United States Patent
Davis

(10) Patent No.: US 8,215,889 B2
(45) Date of Patent: Jul. 10, 2012

(54) SYSTEM AND METHOD FOR HIGH CURRENT RECOVERY CURSOR

(75) Inventor: Charles Irwin Davis, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 819 days.

(21) Appl. No.: 12/257,973

(22) Filed: Oct. 24, 2008

(65) Prior Publication Data

US 2010/0101477 A1 Apr. 29, 2010

(51) Int. Cl.
*B63B 27/00* (2006.01)
*B63C 11/00* (2006.01)
*G10K 11/00* (2006.01)

(52) U.S. Cl. ..... 414/137.7; 114/375; 114/258; 405/3

(58) Field of Classification Search ..... 114/258, 114/259, 366, 368, 375, 377, 378, 382, 48, 114/51, 73; 187/261, 406, 410; 405/3; 414/137.1, 414/137.2, 137.4, 137.7, 137.9, 138.2, 138.4, 414/138.8, 139.5, 140.1, 142.6, 142.8, 143.2, 414/595

See application file for complete search history.

(56) References Cited

U.S. PATENT DOCUMENTS

| | | | | | |
|---|---|---|---|---|---|
| 3,993,011 | A | * | 11/1976 | Garland | 414/137.7 |
| 4,165,706 | A | * | 8/1979 | Parsons | 114/258 |
| 4,245,578 | A | * | 1/1981 | Bianco et al. | 114/312 |
| 5,131,502 | A | * | 7/1992 | Sermi | 187/261 |
| 6,085,683 | A | * | 7/2000 | French et al. | 114/258 |
| 6,161,653 | A | * | 12/2000 | Skalski et al. | 187/305 |
| 2009/0308299 | A1 | * | 12/2009 | Luccioni et al. | 114/230.23 |
| 2010/0101477 | A1 | * | 4/2010 | Davis | 114/382 |

FOREIGN PATENT DOCUMENTS

| | | | | |
|---|---|---|---|---|
| GB | 2076748 | A | * | 12/1981 |
| WO | WO 8907068 | A1 | * | 8/1989 |
| WO | WO 2008012472 | A1 | * | 1/2008 |

* cited by examiner

*Primary Examiner* — Gregory Adams
(74) *Attorney, Agent, or Firm* — Gary R. Maze; Berenbaum Weinshienk PC

(57) ABSTRACT

A high current cursor comprises a outer frame in which a center carriage travels. The center carriage travels between the top and bottom of the outer frame. Movement of the center carriage is limited within the outer frame constraints and its own locking mechanism. Center carriage carries a bend restrictor for an umbilical or lift line. When the center carriage travels down to a predetermined position within the high current cursor, equipment is allowed to exit the high current cursor or is retrieved back into the high current cursor when the bend restrictor reaches a predetermined position within the outer frame, e.g. at its lowest point, allowing dispersal and/or retrieval without obstruction back to a fixed recovery point.

23 Claims, 12 Drawing Sheets

SYSTEM AND METHOD FOR HIGH CURRENT RECOVERY CURSOR

FIELD OF THE INVENTION

The present invention relates to cursors used to deploy and retrieve equipment. More specifically, present invention relates to cursors used in high current fluids such as oceans.

BACKGROUND OF THE INVENTION

A high current cursor is a guided mechanical protective cage with an inner traveling carriage designed for safe deployment and recovery of tethered equipment and out of high current fluids, e.g. ocean currents with high wave conditions where currents may be in the 3 to 5 knot range.

Currents in certain ranges, e.g. around 3 to 5 knots, drag equipment away from a recovery point such as might occur if using a cursor to deploy and/or retrieve the equipment. The extreme angle created in the lift line between the equipment and the point of recovery can cause the lift line to interfere with a typical protective cage, resulting in unwanted abrasive wear and a sharp bend radius on the line. If in contact the resulting forces of the lift line can also begin to raise the protective cage exposing the lift line and equipment to damage against the vessel or guidance system. Under these conditions the equipment becomes un-recoverable due to interference with cage and guidance system which was meant to protect it.

SUMMARY

The high current cursor rests on and surrounds equipment to be deployed or retrieved and is typically restrained laterally by a guidance system fixed to the vessel. The cursor traverses from the top to the bottom of the guidance structure, following the guidance system, stabilizing the equipment laterally against displacement by vessel motion, waves, and current as it passes though the air/water interface.

During deployment, the high current cursor stops at the bottom of the vessel's guidance structure. A center carriage of the high current cursor moves with the equipment to the bottom the high current cursor's outer frame as the equipment drops out of the high current cursor's protective frame. The equipment is then free to deploy clear of any structure which could foul the lift line or damage the equipment.

During recovery, the equipment can be pulled safely back to the center of the high current cursor. The high current cursor outer frame remains at the bottom of the guidance system as the center carriage and equipment move up into its protective environment. Once in the high current cursor, the entire package moves up the guidance system and safely recovered on vessel's deck.

DETAILED DESCRIPTION OF PREFERRED EMBODIMENTS

Design characteristics of high current cursor 10 (FIG. 2) allow recovery of equipment in high fluid currents such as might be found in ocean current conditions or high wind. It provides a means for a deployed piece of equipment, e.g. a remotely operated vehicle, to be recovered under these conditions by allowing the equipment to be reeled in below the surface of a recovery system such as a vessel without obstruction to the fixed point of recovery. The point of recovery is the high current cursor where it then enters its protective cage and is recovery back up to the recovery point. In the prior art illustrated, high current cursors are rigid cages.

Figure 1:
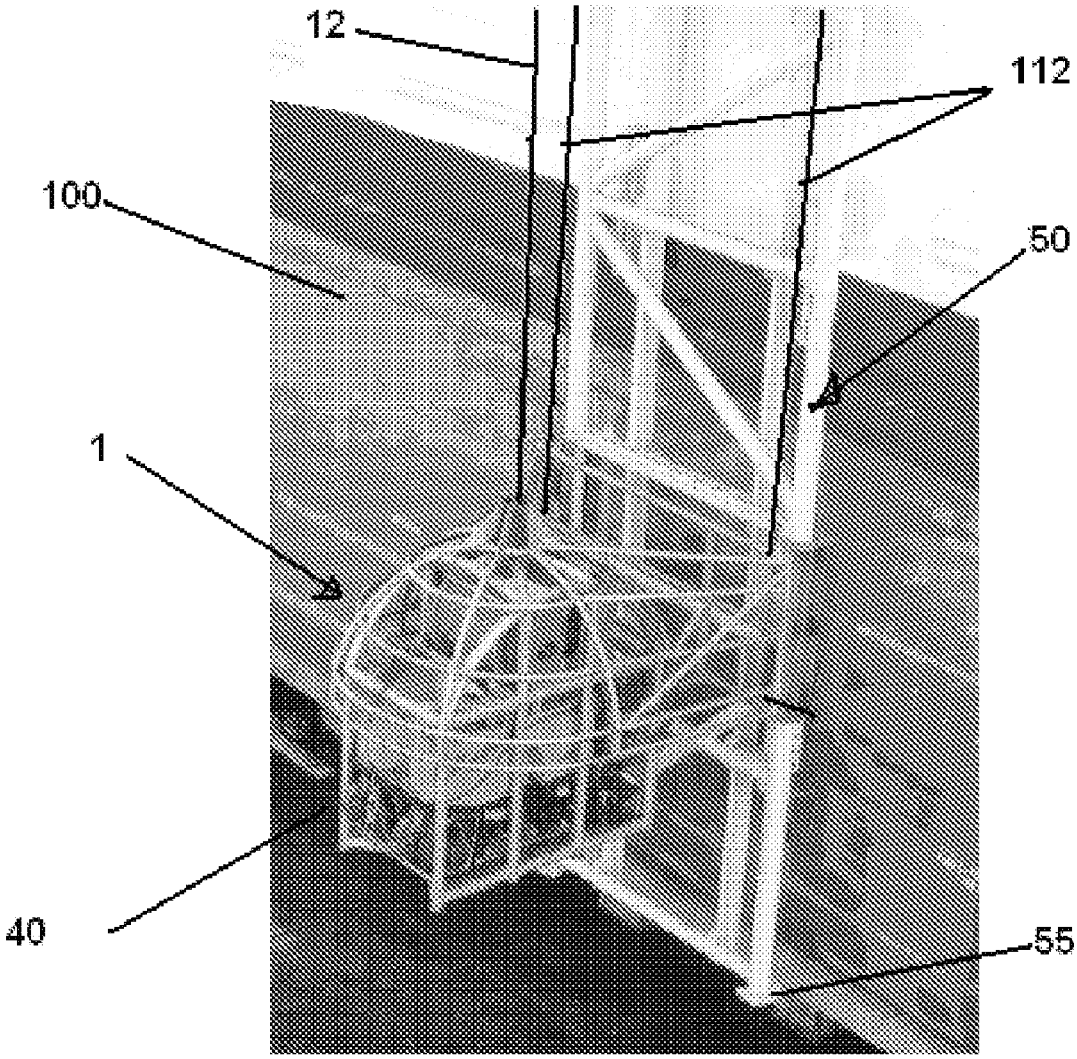
FIG. 1 illustrates a prior art cursor system.

Referring to FIG. 1, in current configurations, guidance system 50 is oriented vertically and connected to a structure such as vessel 100 if cursor 1 is deployed at sea. Guidance system 50 is at least one of a rigid material, a semi-rigid material, a tensioned semi-compliant wire rope, or the like, or a combination thereof. In some configurations, guidance system 50 further comprises stop 55 which impedes movement of cursor 1 along guidance system 50, if not prevents such travel in a predetermined direction all together.

Figure 2:
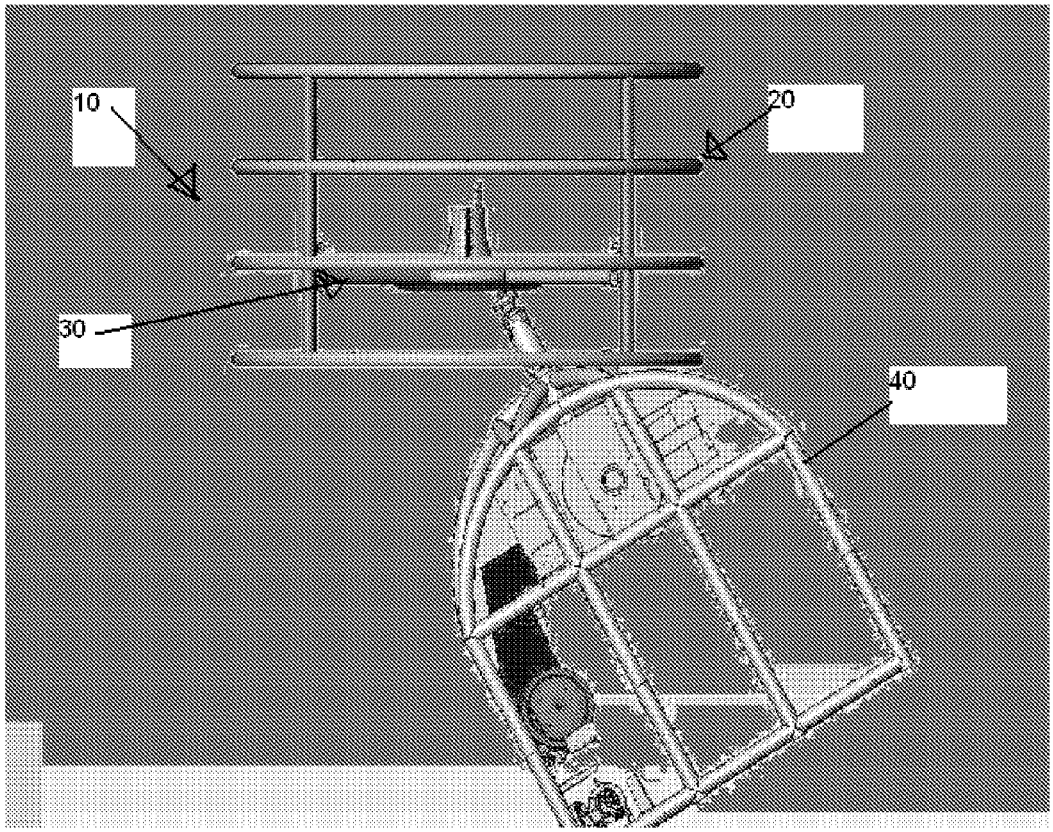
FIG. 2 illustrates a side view of an exemplary embodiment showing equipment nearly retrieved into the high current cursor.

Referring now to FIG. 2, high current cursor 10 comprises outer frame 20 which provides primary protection for equipment 40 and center carriage 30.

Figure 3:
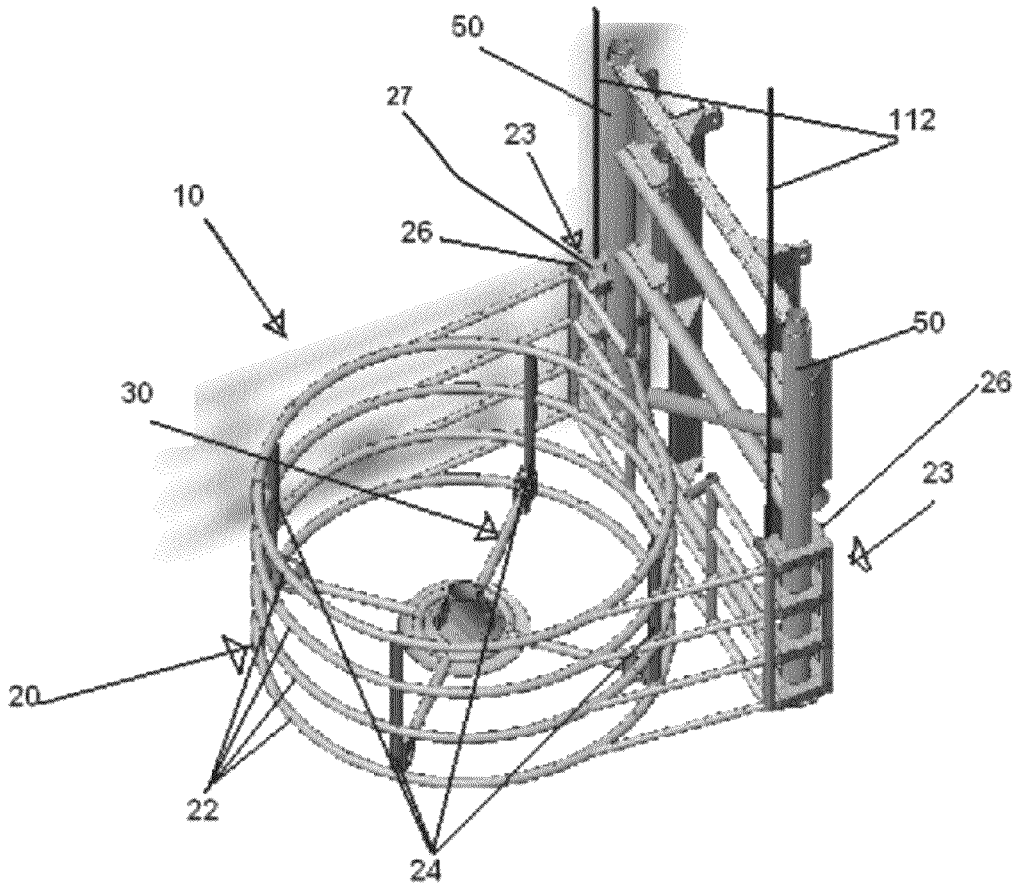
FIG. 3 is a top down, isometric view in partial perspective of an exemplary embodiment showing the high current cursor with the center carriage deployed near the bottom of the outer frame.

Referring additionally to FIG. 3, outer frame 20 comprises one or more frame members 22 and an interface to guidance system 50, e.g. guidance system follower 23. In a currently preferred embodiment, outer frame 20 comprises a plurality of frame members 22, preferably at least four frame members 22. Outer frame 20 is also dimensioned and adapted to accept and carry center carriage 30.

Outer frame 20 further comprises one or more frame guides 24 connected to one or more of the plurality of frame members 22.

Guidance system follower 23 is adapted to slidingly engage guidance system 50. In currently contemplated configurations, guidance system follower 23 comprises a tubular, a guide, a slide, or a roller, or the like, or a combination thereof.

Outer frame 20 typically comprises brake 26 adapted to engage guidance system 50. Brake 26 may be integrated with guidance system follower 23 to interface guidance system 50. Brake 26 may further comprise an override 27.

Figure 4A:
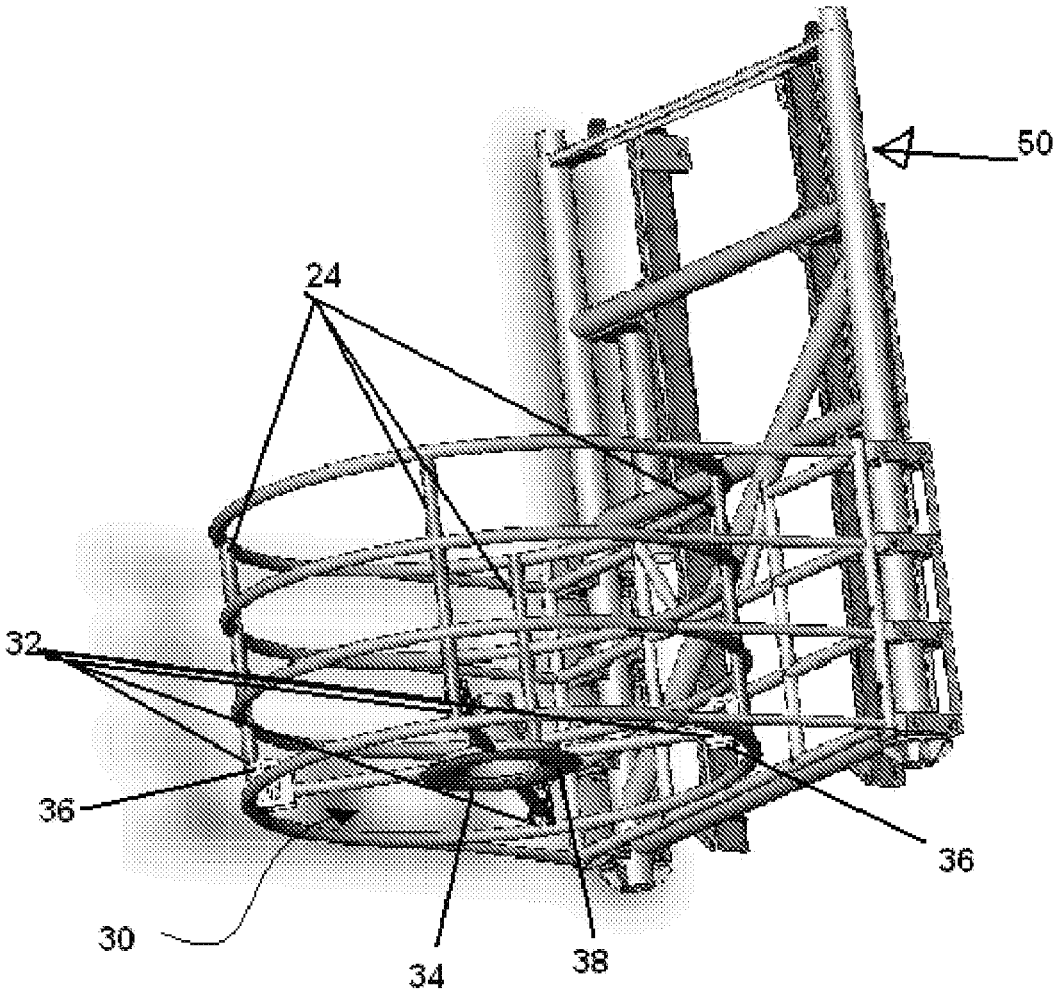
FIG. 4*a* is a view in partial perspective from a bottom of an exemplary embodiment showing a center carriage deployed near the bottom of the outer frame.
Figure 4B:
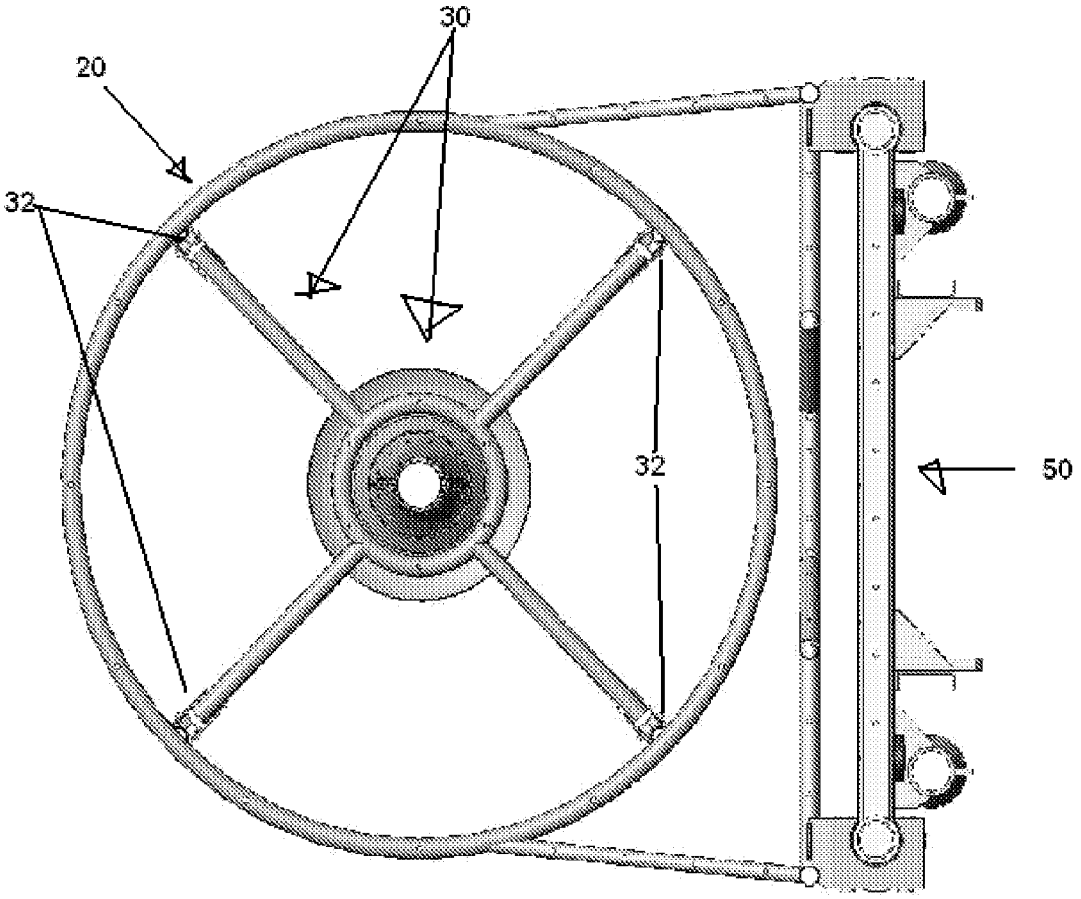
FIG. 4*b* is a top down view in partial perspective from a bottom of an exemplary embodiment showing the center carriage deployed near the bottom of the outer frame.

Referring additionally to FIGS. 4*a*-4*b*, center carriage 30 further comprises one or more carriage guides 32 which are dimensioned and adapted to engage with and be guided vertically within outer frame 20, e.g. by frame guides 24; and bend restrictor 34 that is attached to a central portion of center carriage 30 and dimensioned and adapted to accept cable 12 (FIG. 1) such as an umbilical therethrough.

Figure 5:
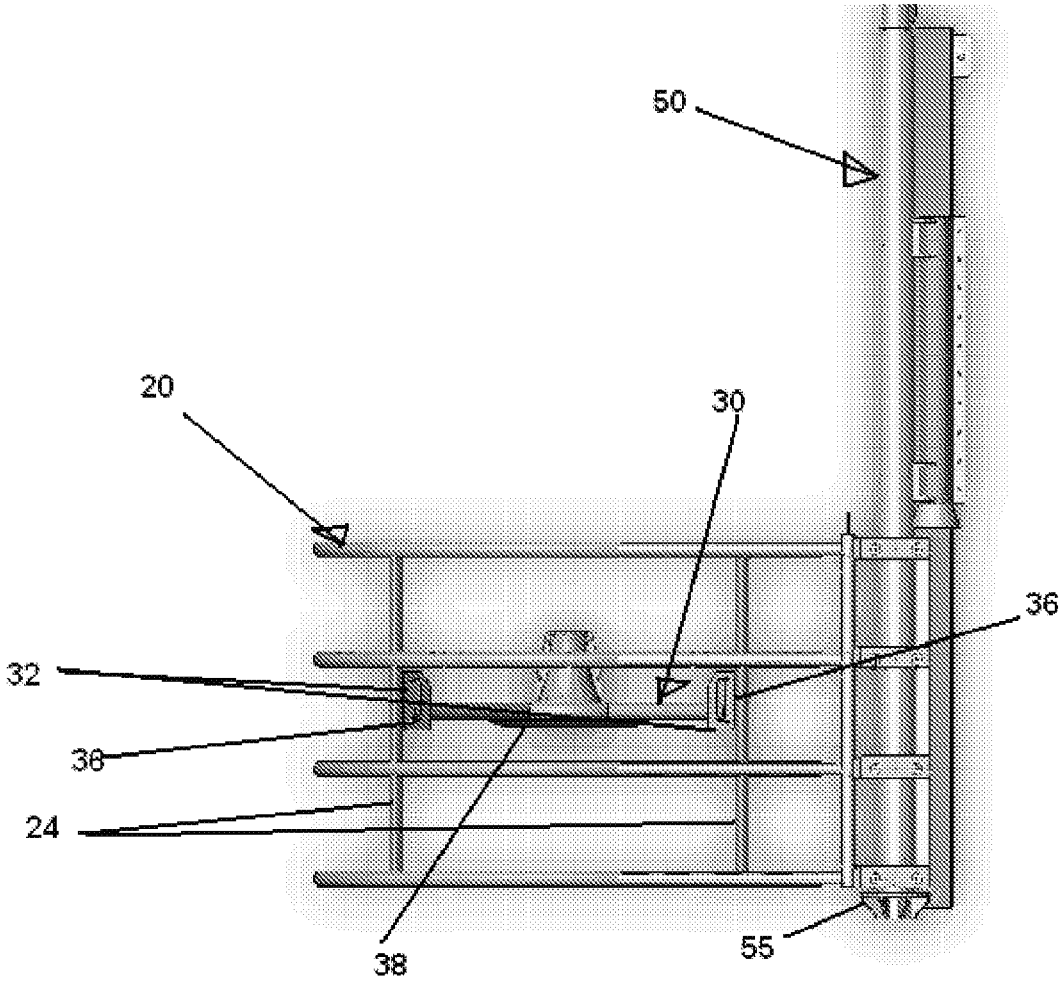
FIG. 5 is a side view in partial perspective of an exemplary embodiment showing the center carriage deployed near the middle of the outer frame.

Referring additionally to FIG. 5, in preferred embodiments, carriage guide 32 comprises one or more rollers or slides or the like, or a combination thereof. In a preferred embodiment, center carriage 30 travels vertically inside outer frame 20, e.g. center carriage 30 is guided within outer frame 20 by using carriage guides 32 to slidingly traverse frame guides 24. Carriage guide 32 may further comprise brake 36 operatively in communication with outer frame 20 such as by being in selective communication with frame guides 24.

In a preferred embodiment, travel of center carriage 30 within outer frame 20 is limited in travel by outer frame constraints, e.g. center carriage 30 travels between top and bottom portions of outer frame 20.

Center carriage 30 may further comprise a vertical restraint system such as brake 36 which may be adapted to engage frame guide 24 when equipment 40 is moved away from bend restrictor 34 and center carriage 30 reaches the bottom of outer frame 20.

Figure 6:
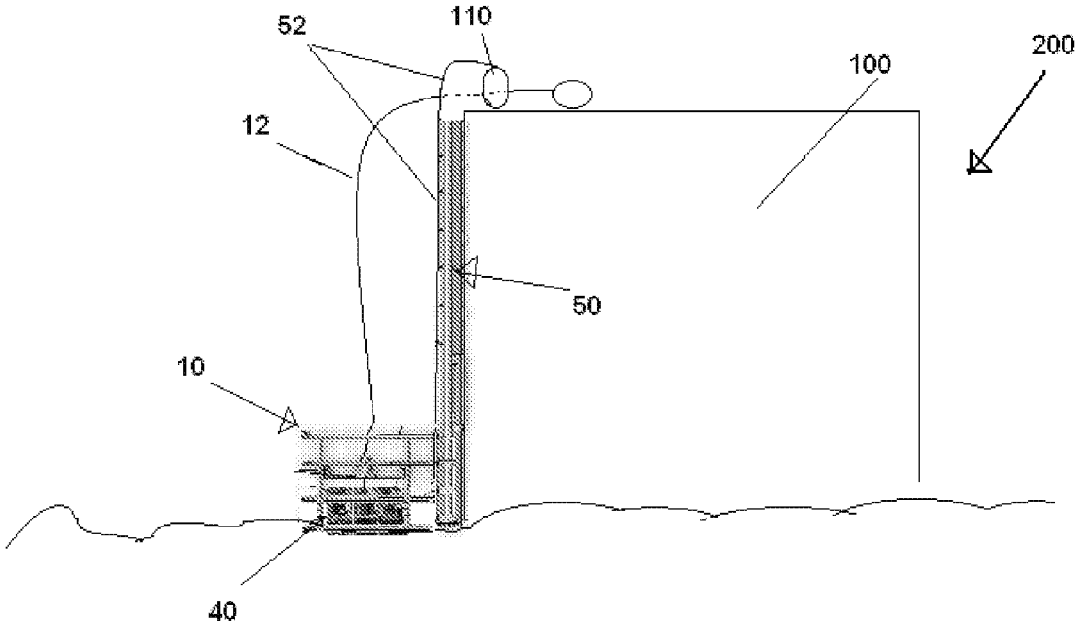
FIG. 6 is a system view in block perspective.

Referring to FIG. 6, system 200 may be used for maneuvering equipment subsea, such as (but not limited to) a remotely operated vehicle. In a currently preferred embodiment, system 200 comprises high current cursor 10 and one or more winches 110 operatively connected to outer frame 20. High current cursor 10 is typically as described above, i.e. comprising outer frame 20 and center carriage 30.

Figure 7A:
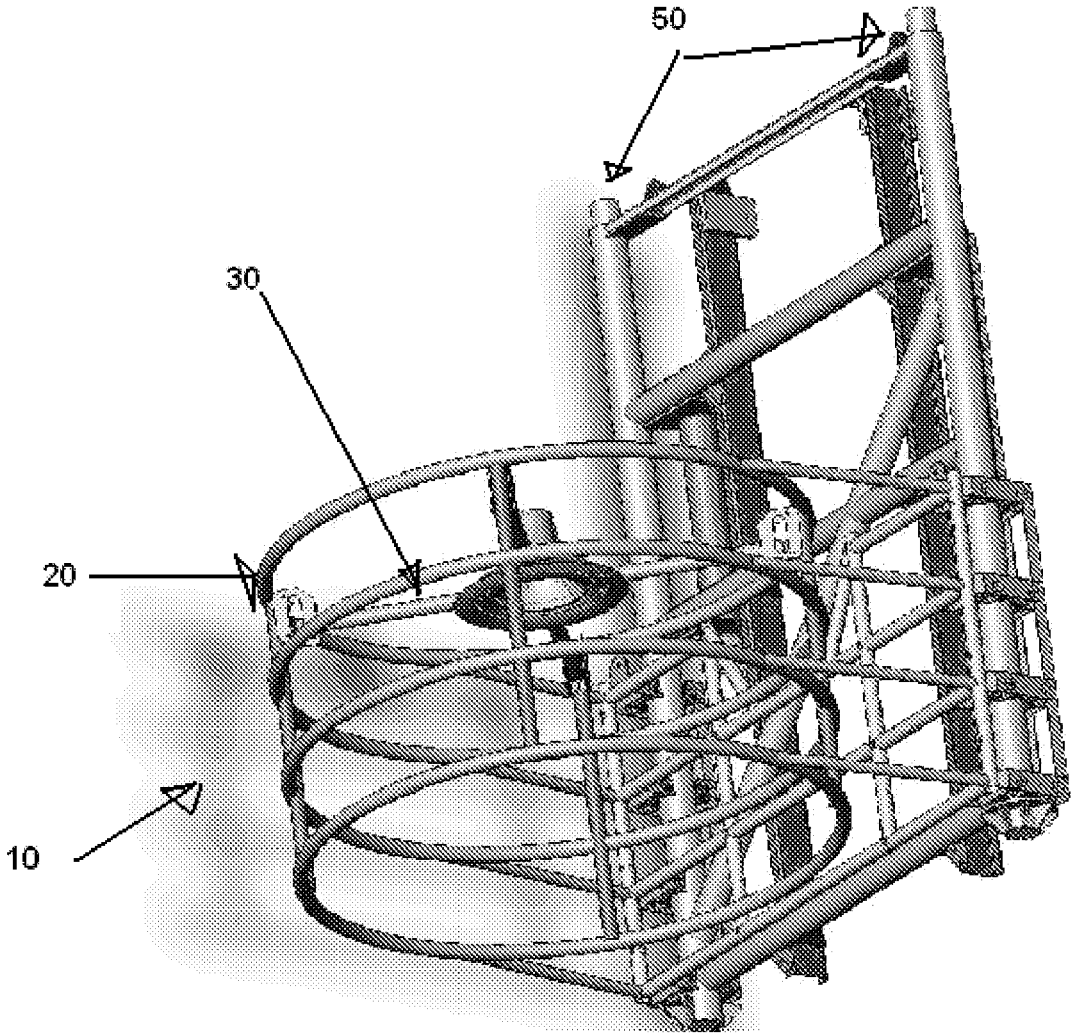
FIGS. 7*a*-7*d* illustrate an exemplary embodiment in partial perspective views during deployment and/or retrieval.
Figure 7B:
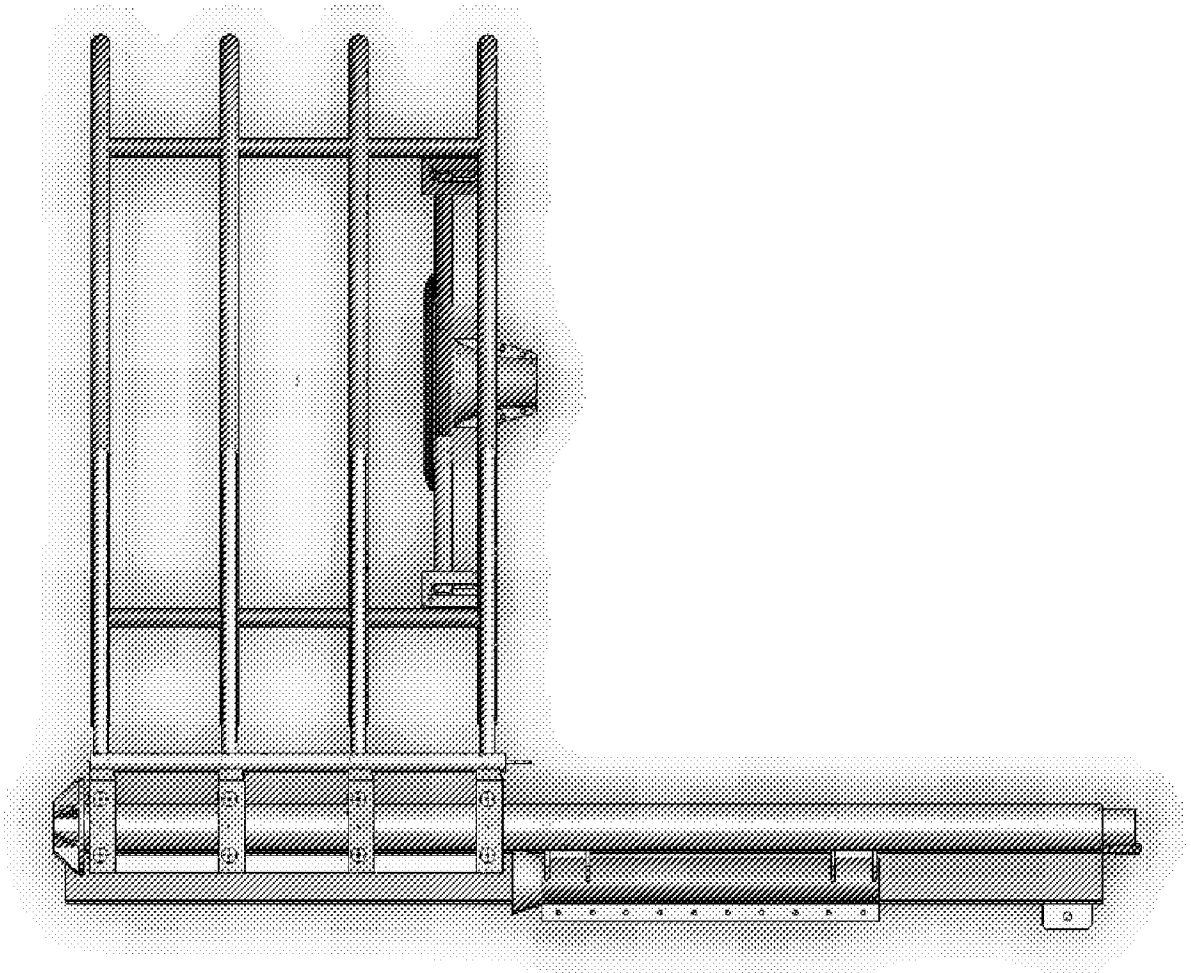
Figure 7C:
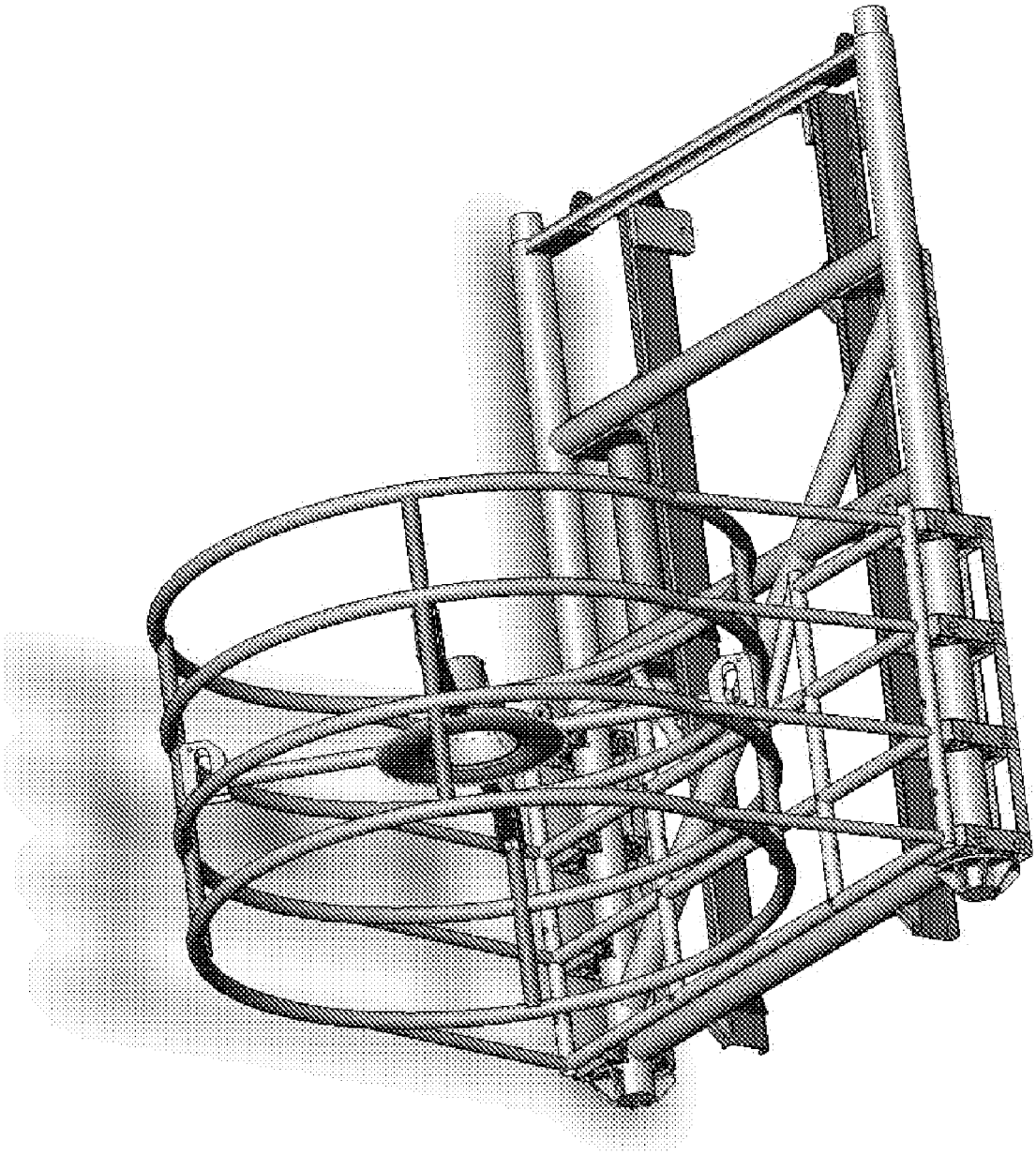
Figure 7D:
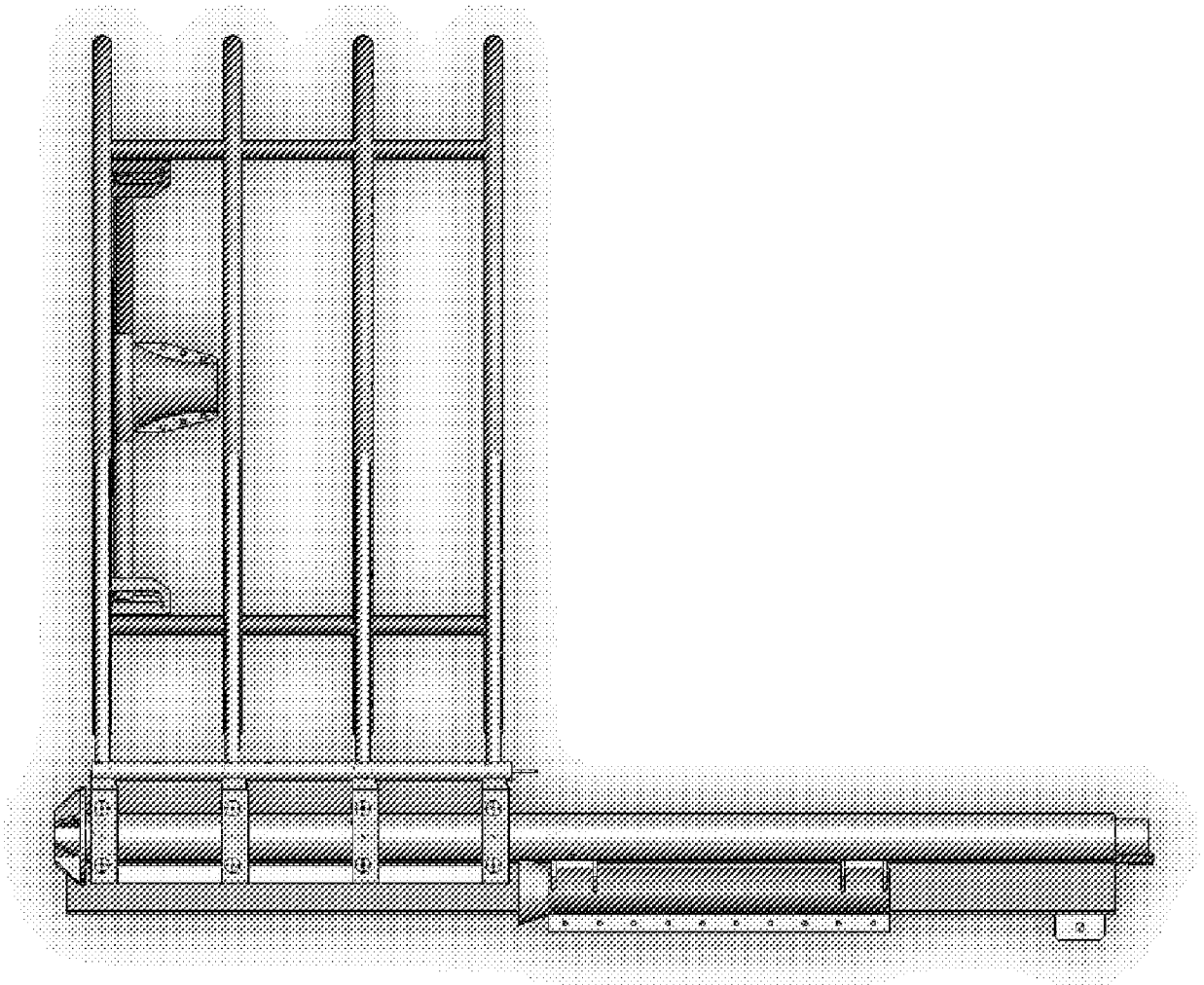

In the operation of preferred embodiments, Referring to FIGS. 7*a*-7*d*, high current cursor 10 may be deployed by at least partially enveloping piece of equipment 40 (FIG. 8) by center carriage 30. As illustrated in FIG. 7*a*, center carriage 30 may be positioned at the top of outer frame 20 of high current cursor 10 where high current cursor 10 is as described herein above.

High current cursor 10 may then be maneuvered to a predetermined position with respect to a delivery point such as via guidance system 50. For the remainder of this exemplary description, the delivery point is a body of water, e.g. at a predetermined distance from vessel 100 (FIG. 1) to which high current cursor 10 is attached. However, it is understood that high current cursor 10 may be used in environments other than water.

Once high current cursor 10 reaches a predetermined vertical position, center carriage 30 may be moved towards the bottom of high current cursor 10 (FIGS. 7*b*-7*d*) and equipment 40 (FIG. 8) removed from center carriage 30 such as by allowing equipment 40 to move on umbilical 12 (FIG. 1) away from center carriage 30. In certain embodiments, it is preferable to engage brake 36 (FIG. 5) to secure center carriage 30, e.g., once center carriage 30 has reached its lowest point of travel within outer frame 20.

Figure 8:
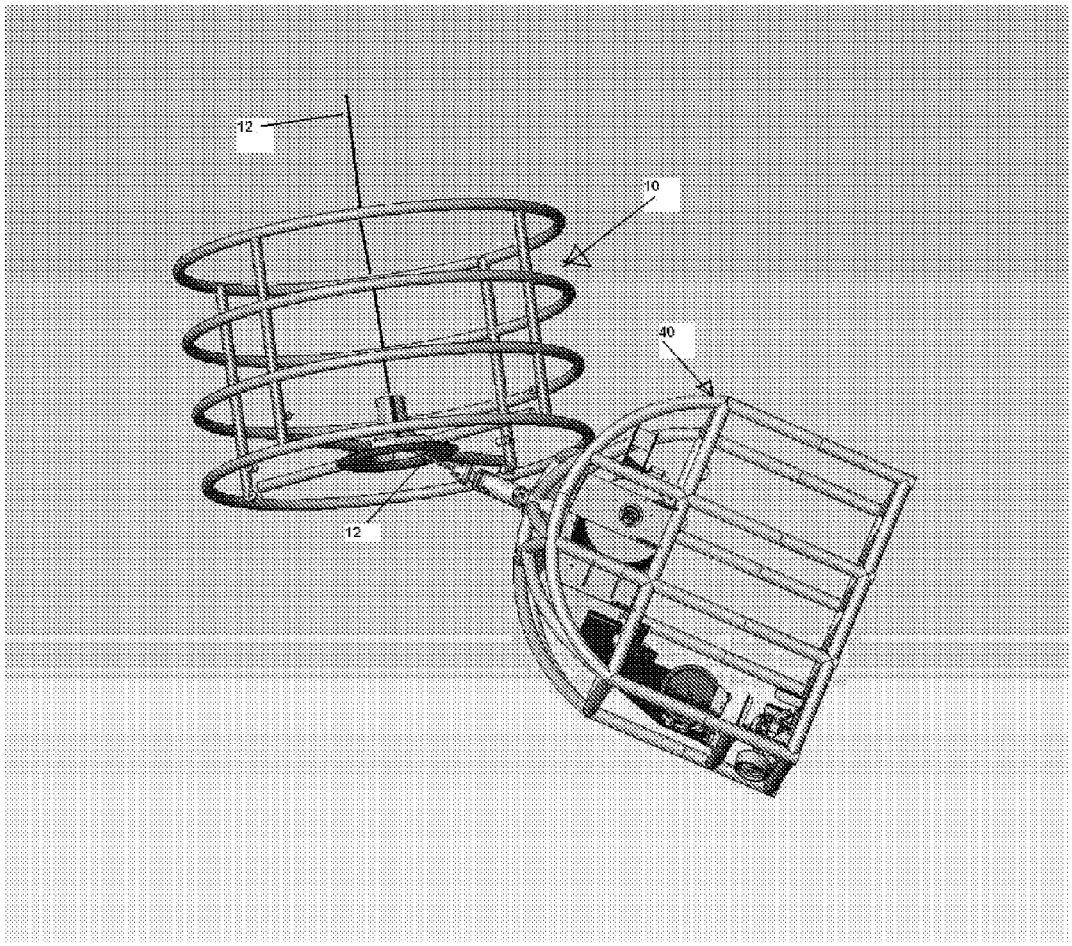
FIG. 8 illustrates an exemplary embodiment during deployment and retrieval in a side partial perspective view.

Referring now additionally to FIG. 8, which illustrates equipment 40 when center carriage 30 is down into outer frame 20, e.g. completely down, equipment 40 may be recovered using high current cursor 10. In preferred embodiments, center carriage 30 is lowered to its lowest point within outer frame 20, effectively lowering bend restrictor 34 to its lowest point as well. Equipment 40 is retrieved into center carriage 30 and center carriage 30 retrieved into outer frame 20. The entire high current cursor 10 may then be retrieved with equipment 40.

For either dispersal or retrieval, high current cursor 10 may traverse from the top to the bottom of guidance structure 50, e.g. deployed along guidance structure 50 to a predetermined depth such as near the bottom of vessel 100 (FIG. 1). Movement of high current cursor 10 may be stopped at a predetermined portion of guidance system 50, e.g. at the bottom of guidance system 50, during deployment or retrieval.

In certain embodiments, it may be desirable to trigger equipment trigger 38 (FIG. 4*a*) by the release of center carriage 30 as it is retrieved into outer frame 20 and use trigger 38 to release brake 36. In other currently contemplated embodiments, brake 36 is released by center carriage 30 when center carriage 30 reaches a predetermined position relative to high current cursor 10. Brake 26 may also be released using override 27 such as one controlled from the surface. It may further be desirable to retrieve the entire high current cursor 10 with equipment 40 to the surface after brake 26 is released.

As described above, high current cursor 10 may be restrained laterally by guidance system 50 fixed to vessel 100 (FIG. 1). Guidance system 50 may be used to stabilize equipment 40 laterally against displacement by vessel motion, waves, current, and the like as equipment 40 passes though the air/water interface by causing high current cursor 10 to follow guidance system 50.

Referring additionally to FIG. 6, In some embodiments, winch 110, operatively connected to outer frame 20, may be used to handle a predetermined amount of the weight of high current cursor 10 and equipment 40. It will be understood that winch 110 may comprise a plurality of winches 110. In certain embodiments, carriage brake 36 is released when it comes in contact with equipment 40. When the equipment 40 is in no longer in contact with the brake operating mechanism the brake is then engaged. In other embodiments, only brake 26 will be released from the surface override, e.g. using assist winch lines 112, to act as a secondary release for this brake.

Vertical motion of high current cursor 10 may be controlled by lift line 52 (FIG. 1) operatively connected to equipment 40. Further, cursor resistance to being raised may be provided by using the weight of high current cursor 10, brakes 26 and/or 36, or the like, or a combination thereof. If using brake 26, an assist winch line 112 may also be used as a secondary release of brake 26. When assist winch lines 112 are tensioned they act as a secondary release to brake 26. Brake trigger 38 may be engaged by center carriage 30 to act as the primary release for brake 36.

The foregoing disclosure and description of the inventions are illustrative and explanatory. Various changes in the size, shape, and materials, as well as in the details of the illustrative construction and/or a illustrative method may be made without departing from the spirit of the invention.

What is claimed is:

1. A high current cursor, comprising:

a. an outer frame, further comprising:

i. a plurality of frame members;

ii. a frame guide connected to at least one of the plurality of frame members;

b. a center carriage, further comprising:

i. a carriage guide dimensioned and adapted to engage with and be guided by the frame guide, the carriage guide further comprising a plurality of support members, at least one support member further comprising a frame guide interface dimensioned and adapted to slidingly engage a frame guide, the frame guide interface comprising at least one of a roller or slide adapted to permit the center carriage to travel vertically inside the outer frame, the travel being limited by outer frame constraints; and ii. a bend restrictor attached to a center top portion of the center carriage, the bend restrictor adapted to accept a cable therethrough; and c. a guidance system follower mounted to at least one of the plurality of frame members, the guidance system follower further comprising a brake dimensioned and adapted to engage the guidance system follower with a guidance structure.

2. The high current cursor of claim 1, wherein the guidance system follower is adapted to slidingly engage at least one of a rigid material, a semi-rigid material, or a tensioned semi-compliant wire rope.

3. The high current cursor of claim 1, wherein the guidance system follower comprises at least one of a guide, slide, or a roller.

4. The high current cursor of claim 1, wherein the brake further comprises an override.

5. The high current cursor of claim 1, wherein the center carriage travel is constrained to be between the top and bottom of the outer frame.

6. The high current cursor of claim 1, wherein the center carriage further comprises a brake operatively in communication with the outer frame.

7. A system for maneuvering equipment, comprising:

a. a guidance system;

b. a high current cursor, comprising:

i. an outer frame, further comprising:

ii. a plurality of frame members;

iii. a vertical guide connected to at least one of the plurality of frame members;

iv. a center carriage, further comprising:

1. a carriage guide slidingly connected to the vertical guide;

2. a center mounted bend restrictor adapted to receive a cable therethrough, the center mounted bend restrictor connected to the carriage guide; and 3. a brake operatively connected to the carriage guide;

c. a guidance system follower mounted to at least one of the plurality of frame members and slidingly connected to the guidance system; and d. a winch operatively connected to the outer frame.

8. The system of claim 7, wherein the guidance system follower further comprises a brake in communication with the guidance system follower.

9. A method of deploying a high current cursor, the high current cursor comprising an outer frame comprising a top and a bottom and a center carriage disposed at least partially within and movably connected to an interior of the outer frame, the method comprising:

a. enveloping piece of equipment at least partially by the center carriage;

b. positioning the center carriage at the top of the outer frame;

c. maneuvering the high current cursor to a predetermined position along a guidance system with which the high current cursor is slidingly engaged;

d. moving the center carriage to the bottom of the outer frame;

e. engaging a center carriage brake to secure the center carriage within the interior of the outer frame; and f. deploying the equipment.

10. A method of recovering a piece of equipment using a high current cursor, the high current cursor comprising a outer frame comprising a top and a bottom and a center carriage disposed at least partially within and movably connected to an interior of the outer frame, the method comprising:

a. maneuvering the high current cursor to a predetermined position along a guidance system with which the high current cursor is slidingly engaged;

b. lowering the center carriage to its lowest point within the outer frame;

c. retrieving the equipment into the center carriage; and d. moving the center carriage into the outer frame proximate the top of the outer frame.

11. The method of claim 10, further comprising:

a. triggering an equipment trigger by the release of the center carriage as it is retrieved into the cursor outer frame; and b. releasing a outer frame brake.

12. The method of claim 11, wherein the outer frame brake is released by the center carriage when the center carriage reaches a predetermined position relative to the high current cursor.

13. The method of claim 11, wherein the outer frame brake is released using an override controlled from the surface.

14. The method of claim 11, further comprising recovering the entire high current cursor with the equipment to the surface after the outer frame brake is released.

15. The method of claim 10, further comprising:

a. fixing the guide substantially laterally to a vessel; and b. restraining the high current cursor via the guide.

16. The method of claim 15, further comprising using the guide to stabilize the equipment laterally against displacement by vessel motion, waves, and current as it passes though the air/water interface by causing the high current cursor to follow the guide.

17. The method of claim 15, wherein:

a. disposing a bottom portion of the guide near the bottom of the vessel; and b. allowing the high current cursor to traverse from a first predetermined position near the top of the guide to a second predetermined position near the bottom of the guide.

18. The method of claim 17, further comprising stopping movement of the high current cursor at the bottom of the guide during deployment.

19. The method of claim 10, further comprising using a winch operatively connected to the cursor outer frame to handle a predetermined amount of the weight of the cursor and its equipment.

20. The method of claim 19, wherein the winch comprises a plurality of winches.

21. The method of claim 10, further comprising controlling vertical motion of the cursor by a lift line operatively connected to the equipment.

22. The method of claim 10, further comprising providing cursor resistance to being raised by using at least one of (a) the cursor's own weight or (b) a braking system.

23. The method of claim 22, if using the braking system, further comprising using an assist winch line as a secondary release of the braking system.

* * * * *